US005697407A

United States Patent [19]

Lasonde

[11] Patent Number: 5,697,407

[45] Date of Patent: Dec. 16, 1997

[54] COMPOUNDING SYSTEM FOR MULTIPLE CHAMBER RECEPTACLES

[75] Inventor: Gregory J. Lasonde, Lake Bluff, Ill.

[73] Assignee: The Metrix Company, Dubuque, Iowa

[21] Appl. No.: 565,226

[22] Filed: Nov. 30, 1995

[51] Int. Cl.[6] ..... B65B 3/00

[52] U.S. Cl. ..... 141/104; 141/9; 141/10; 141/236; 141/313; 141/317; 141/327

[58] Field of Search ..... 141/83, 100, 104, 141/114, 234, 236, 313, 314, 317, 325–327, 9, 10; 604/410

[56] References Cited

U.S. PATENT DOCUMENTS

| | | | |
|---|---|---|---|
| 2,830,396 | 4/1958 | Gowland | 141/313 X |
| 3,796,239 | 3/1974 | Zindler et al. | 141/83 |
| 4,513,796 | 4/1985 | Miller et al. | 141/83 |
| 4,576,603 | 3/1986 | Moss | 604/410 |
| 4,608,043 | 8/1986 | Larkin | 604/410 X |
| 4,712,590 | 12/1987 | Gianfilippo | 141/83 |
| 4,789,014 | 12/1988 | DiGianfilippo et al. | 141/83 |
| 4,925,444 | 5/1990 | Orkin et al. | 604/80 |
| 5,257,985 | 11/1993 | Puhl | 604/410 |
| 5,431,496 | 7/1995 | Balteau et al. | 604/410 X |

FOREIGN PATENT DOCUMENTS

| | | | |
|---|---|---|---|
| 2570279 | 3/1986 | France | 604/410 |

*Primary Examiner*—J. Casimer Jacyna

*Attorney, Agent, or Firm*—Mason, Kolehmainen, Rathburn & Wyss

[57] ABSTRACT

A high speed bulk compounder system for filling upper and lower chambers of dual chamber TPN bags with fluid from source containers includes a controller for controlling the operation of peristaltic pump stations, each station being associated with one of the source containers. The controller activates the peristaltic pumps sequentially to draw fluids from certain ones of the source container so that the fluids flow through a common manifold and a lower chamber fill tubing into the lower chamber of the dual chamber bag. Once the lower chamber has been filled, another pump station is activated so that fluid is drawn from another of the source containers and flows through an upper chamber connector, through an upper chamber fill tubing and into the upper chamber of the dual chamber bag.

11 Claims, 1 Drawing Sheet

COMPOUNDING SYSTEM FOR MULTIPLE CHAMBER RECEPTACLES

BACKGROUND OF THE INVENTION

1. Field of the Invention

The present invention relates generally to a compounder system for precisely transferring solutions at a high speed into a receiving receptacle and more particularly, to a new and improved compounder system for precisely transferring different types of solutions into separated chambers of a receiving receptacle.

2. Background of the Invention

Individuals who cannot ingest food orally in a sufficient amount to meet their protein and caloric requirements must be fed intravenously. The solutions that are to be administered intravenously are transferred into a total parental nutrition bag (commonly referred to as a TPN bag). Such bags are designed for home use and once filled, can be stored in a standard refrigerator. The bags are filled with the solutions by a pharmacy technician either by gravity or by a device known as a high speed bulk compounder. Such compounders typically are capable of supplying solutions from up to six different source bags or containers to a receiving bag at relatively high flow rates.

The source containers may be hung from a framework of the compounder while the receiving bag is hung from a load cell that measures the weight of the receiving bag. A pump set consisting of a number of pump legs (for example, up to six such legs) or flow paths is designed to be used with the compounder. Each of the pump legs includes flexible tubing and terminates on one end with a piercing administration spike or similar connector that is used to connect the leg of the pump set to one of the source containers. The other end of each leg is coupled to one of the inlet ports of a common manifold equipped with an exit port that is adapted to be coupled to a fill tubing connected to the receiving bag.

Each leg of the pump set is associated with a different peristaltic pump or pump station of the compounder. A microprocessor in the compounder controls each of the peristaltic pumps or pump stations to thereby control the amount of solution being supplied from each source container through the particular pump leg and the manifold to the receiving bag. The amount of solution being supplied from each source container is in part determined by information being supplied to the microprocessor of the weight being measured at selected times by the load cell from which the receiving bag is suspended. The peristaltic pumps draw solutions from each of the source containers sequentially under the control of the microprocessor and the solutions flow through the common manifold and the fill tubing into the receiving bag.

In at least some instances, the solutions to be transferred into such receiving TPN bags include a lipid solution and two-in-one solutions (primarily amino acids and dextrose). Once these types of solutions are mixed together, the shelf life for the mixed solution (i.e., the amount of time before the solution needs to be used) is relatively short. For example, the solutions after being mixed may form insoluble precipitates which prevents them from being used as an intravenous administered solution. As a result, dual chamber TPN bags have been developed to maintain these solutions separated until shortly before they are to be used.

A dual chamber TPN bag includes two chambers that are initially separated. The two-in-one solutions are transferred into one of the chambers and the lipid solutions are transferred into the other chamber. Just prior to the time that the solutions in the TPN bag are to be administered to a patient, a divider mechanism that maintains the chambers separated is removed so that the two chambers effectively become one larger chamber in which the solutions are mixed. Consequently, the shelf life of the contents in the dual chamber TPN bag is extended by keeping the contents separated until just before actual use.

The filling of the solutions into the separated chambers of a dual chamber TPN bag by a compounder is somewhat more involved and time consuming than the filling of a single chamber bag. In the case of compounder having six pumping stations for six different source solutions where five of the solutions are to be transferred to one of the chambers and the sixth solution is to be transferred to the other chamber, a single six leg pump set typically is used with each of the legs of the pump set being connected to the receiving bag through the common manifold. The dual chamber bag is suspended from the load cell so that one of the chambers is positioned above the other of the chambers in the dual chamber TPN bag. A fill tubing from the lower chamber of the TPN bag is connected to the exit port of the manifold. The microprocessor in the compounder is programmed to sequentially fill the lower chamber with solutions from the five source containers associated with the first five pump stations by sequentially activating the first five pump stations so that the solutions from the first five source containers are transferred via the common manifold and the lower fill tubing to the lower chamber. After the lower chamber is supplied with the required amount of fluids, the fill tubing from the lower chamber is sealed.

Once the lower chamber is filled, another dual chamber TPN bag can be placed on the load cell so that the required amount of the first five solutions can be similarly supplied to the lower chamber of that next bag. These same steps can be repeated for any number of bags into which the five solutions or combinations thereof need to be supplied. Before the upper or other chamber of the bag or bags are filled, the manifold has to be flushed to be sure to remove any of solution from the first five source containers remaining in the manifold after the lower chamber is filled. Otherwise, any solution from one of the first five source containers that remains in the manifold will become mixed with the solution from the sixth source container as it is being supplied through the manifold to the upper chamber of the receiving bag. In order to flush the manifold, a waste bag needs to be coupled to the exit port of the manifold. The next fluid to be pumped then is pumped through the manifold to remove any portion of the previously pump solutions still remaining in the manifold.

The upper chamber of the dual chamber TPN bag or bags can now be filled. However, the bag needs to be inverted and suspended in its inverted position from the load cell because the fill tubing for the upper chamber typically is not long enough to be coupled to the manifold. The fill tubing is coupled to the exit port of the manifold and the microprocessor in the compounder is programmed to activate the sixth pump station so that the liquid (i.e., a lipid) is supplied from the sixth source container through the manifold and the upper chamber fill tubing to the upper chamber of the dual chamber TPN bag. The upper chamber fill tubing is sealed and the filled bag is removed from the load cell. The upper chambers of additional bags then can be similarly supplied with the fluid from the sixth source container.

Before the compounder can be used for supplying fluids from the first five source containers to the lower chambers of additional bags, the manifold has to be again flushed of any portion of fluid from the sixth source container that is remaining in the manifold. This again entails coupling a waste bag to the exit port of the manifold and flushing a solution through the manifold.

As can be appreciated, the filling of a dual chamber TPN bag involves additional time consuming operations that are not required when the liquids can be originally mixed together in a single chamber TPN bag. The manifold of the compounder needs to be flushed of any remaining liquids when the different chambers are being filled and the dual chamber TPN bag has to be removed from the load cell and inverted before the second chamber is filled.

SUMMARY OF THE INVENTION

Accordingly, it is an object of the present invention to provide a new and improved high speed bulk compounder system for supplying liquids to the separate chambers of dual chamber TPN bags.

Another object of the present invention is to provide a new and improved high speed bulk compounder system for dual chamber TPN bags that enables the chambers of the bag to be filled without the necessity of flushing the manifold through which the fluids are being supplied.

A further object of the present invention is to provide a new and improved high speed bulk compounder system for dual chamber TPN bags that permits the chambers of a dual chamber TPN bag to be filled without the necessity of removing the bag from a load cell on which it is suspended and inverting the bag prior to the filling of the second chamber of the bag.

Still another object of the present invention is to provide a new and improved high speed bulk compounder system for dual chamber TPN bags having a separate fill path for each of the two chambers of the TPN bag into which solutions are being transferred.

In accordance with these and many other objects of the present invention, a high speed bulk compounder system for dual chamber TPN bags includes a controller for controlling the operation of six peristaltic pump stations, each station being associated with each leg of a pump set so that the fluid from six source containers can be sequentially supplied to appropriate chambers of a receiving bag. The source containers are hung from a framework of the compounder while the receiving bag is hung from a load cell that provides information to a microprocessor in the controller at selected times while the fluids are being supplied as to the weight of the receiving bag. One end of each of the pump legs is connected to one of the source containers. The other end of each of five of the legs is coupled to separate inlet ports of a common manifold equipped with an exit port that is adapted to be coupled to a fill tubing connected to the lower chamber of the dual chamber receiving bag. The other end of the sixth leg is coupled to an upper chamber connector or manifold which in turn is coupled to a fill tubing of the upper chamber of the dual chamber bag. Each leg of the pump set is associated with a different peristaltic pump or pump station of the compounder. In actuality, the compounder may have only one pump motor that rotates an elongated output shaft. A pump for each of the legs of the pump set is mounted on that shaft and is selectively activated by a clutch associated with each pump station. The clutches are controlled by the controller that based on the information provided by the load cell, determines the desired amount of fluid from each of the source containers that is to be transferred to the receiving bag by controlling the actuation of the clutch for each pump station.

In operation, the controller activates the peristaltic pumps sequentially to draw solutions from each of the first five source containers and the solutions from those source containers flow through the common manifold and the fill tubing of the lower chamber of the dual chamber bag into the lower chamber of the receiving bag. Once the lower chamber has been filled, the sixth pump station is activated so that fluid is drawn from the sixth source container through the upper chamber connector and the fill tubing for the upper chamber of the dual chamber bag of that receiving bag. After the upper and lower chambers are filled, the fill tubing for both chambers are sealed and the receiving bag can be removed from the load cell. This filling of both chambers of the dual chamber bag is accomplished without the necessity of flushing the common manifold or inverting the bag to fill the second chamber.

BRIEF DESCRIPTION OF THE DRAWINGS

Many other objects and advantages of the present invention will become apparent from considering the following detailed description of the embodiments of the invention illustrated in the drawing, wherein.

DETAILED DESCRIPTION OF THE PREFERRED EMBODIMENTS

Figure 1:
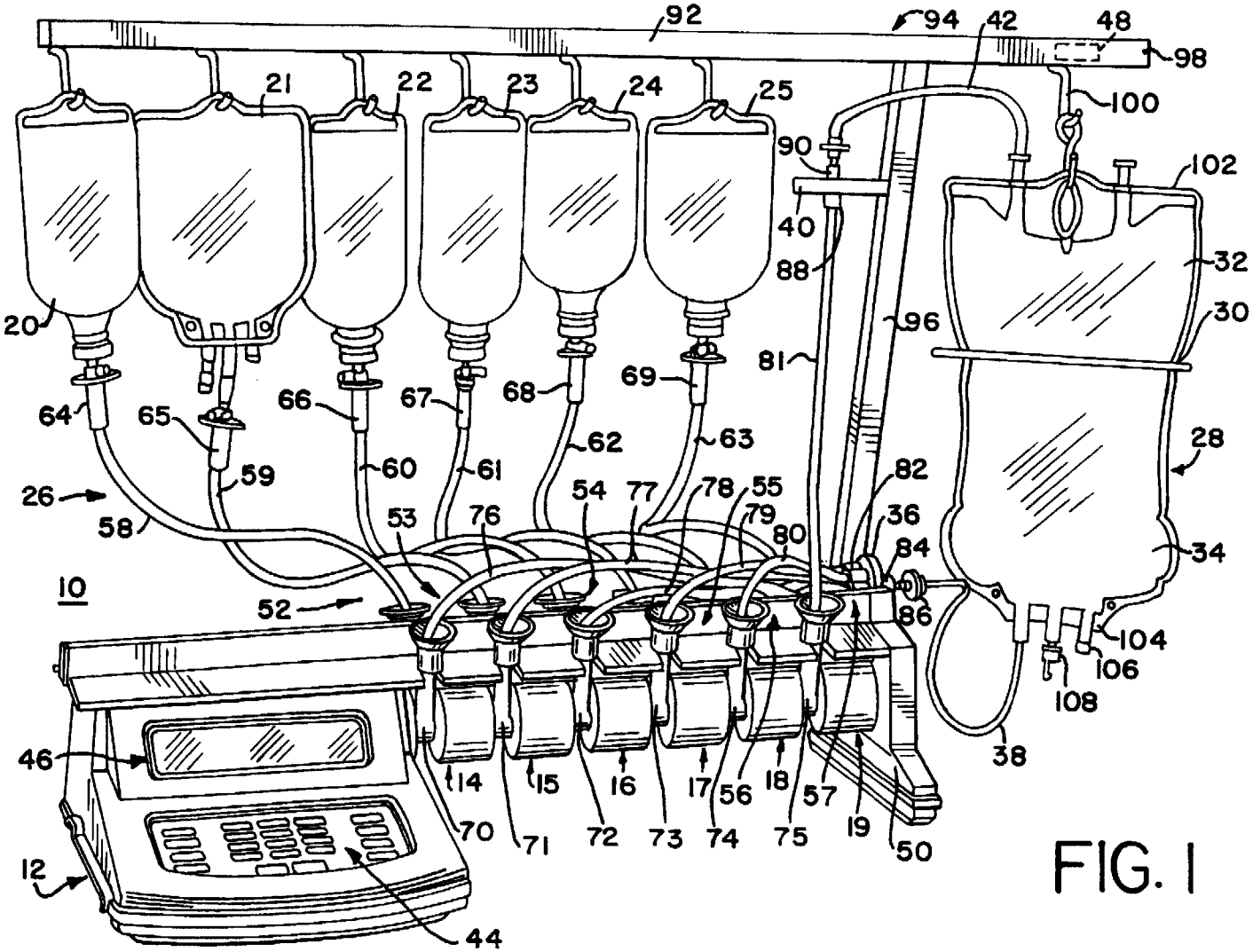
FIG. 1 is a perspective view of the high speed bulk compounder system embodying the present invention.

Referring now more specifically to FIG. 1 of the drawings, therein is disclosed a high speed bulk compounder system generally designated by the reference numeral 10 and embodying the present invention. The compounder system 10 includes a controller 12 that controls the operation of six peristaltic pump stations 14–19 such that fluid from six source bags or containers 20–25 can be transferred via a pump set 26 to a TPN receiving bag 28. As is illustrated in FIG. 1, the receiving bag 28 is a dual chamber bag having a separating mechanism 30 to divide temporarily the bag 28 into an upper chamber 32 and a lower chamber 34. Accordingly, the controller 12 activates the pump stations 14–18 sequentially to pump the fluid from the source containers 2–24 through the pump set 26, a common manifold 36 and a lower chamber fill tubing 38 into the lower chamber 34 and thereafter activates the pump station 19 to pump the fluid from the source container 25 through the pump set 26, an upper chamber connector or manifold 40 and an upper chamber fill tubing 42 into the upper chamber 32.

The controller 12 has a key pad 44 for entering information and a display panel 46 for displaying information as to the liquids and the amounts of those liquids to be transferred from the source containers 20–25 to the receiving bag 28. Based on the information inputted into the controller 12 through the key pad 44 and the weight of the receiving bag 28 supplied to the controller 12 from a load cell 48 at various points in the filing process, a microprocessor (not shown) in the controller 12 selectively and sequentially activates the pump stations 14–19 so that the desired amounts of fluids from the source containers 20–25 are transferred to the receiving bag 28.

In the disclosed embodiment, the compounder 10 has only one pump motor that rotates an elongated output shaft extending from the controller 12 to a support stand 50. Each of the pump stations 14–19 has a clutch mechanism, the actuation of which is controlled by the controller 12. When the clutch for one of the pump stations 14–19 is actuated, fluid from the particular one of the source containers 20–25 associated with that pump station will be supplied to the manifold 36 in the case of pump stations 14–18 or the connector 40 in the case of pump station 19.

The pump set 26 is used to provide a fluid communication path from each of the source containers 20–25 to the manifold 36 or the connector 40. The pump set 26 includes six flexible tubing 52–57 with source tubing legs 58–63 terminating at one end with a piercing administration spike or similar connector 64–69 that is used to connect each of the legs 58–63 to one of the source containers 20–25. The other end of each leg 58–63 is coupled to one of the pump tubing 70–75 that are positioned about the peristaltic pump at each of the pump stations 14–19. As the peristaltic pumps at the pump stations 14–19 are actuated, the pump tubing 70–75 are squeezed so that fluid from the respective source containers 20–25 flow through the source tubing 58–63, the pump tubing 70–75 and output tubing 76–81 to the manifold 36 in the case of the output tubing 76–80 and to the connector 40 in the case of the output tubing 81.

The manifold 36 has inlet ports, such as the inlet ports 82, for each of the output tubing 76–80. Each such inlet port 82 has a check valve within the manifold 36 to insure that fluid can only flow into the inlet ports 82 from the output tubing 76–80 and not out from the manifold 36 to any of the output tubing 76–80. This insures that none of the fluid from any of the source containers 20–24 is inadvertently back fed into another one of the source containers 20–24. The manifold 36 also includes a single exit port 84 that is adapted to be receive a coupling end 86 of the lower chamber fill tubing 38. The exit port 84 has a check valve within the manifold 36 to insure that fluid from the manifold 36 will not flow through the exit port 84 unless the coupling end 86 of the lower chamber fill tubing 38 is inserted into the exit port 84.

The connector 40 is adapted to provide an interface between the output tubing 81 from the pump set 26 to the upper chamber fill tubing 42. The connector 40 can be in the form of a manifold having a check valve associated with an inlet port 88 and a check valve associated with its exit port 90.

The source containers 20–25 are suspended from a support portion 92 of a framework 94 that extends horizontally above the pump stations 14–19 from an upstanding support 96 attached to the support stand 50. A load cell support 98 extends horizontally from the upstanding support 96. The load cell 48 is disposed in the load cell support 98 such that the dual chamber bag 28 is suspended from the load cell 48 by a load cell hook 100. As the fluid is being supplied to the chambers 32 and 34 of the dual chamber bag 28, the load cell 48 provides the microprocessor in the controller 12 with the weight of the receiving bag 28 at various points in the filing process. The controller 12 determines the precise amount of fluid being supplied from each of the source containers 20–25.

The receiving bag 28 is a TPN bag formed of a flexible sheet material having opposed sidewalls 101 extending between an upper edge 102 and a lower edge 104. The receiving bag 28 is subdivided into the upper chamber 32 and the lower chamber 34 by the clamping mechanism 30. As long as the clamping mechanism 30 is clamped across the receiving bag 28 as is illustrated in FIG. 1, the chambers 32 and 34 are maintained separated so that fluid within the chamber 32 does not mix with and is maintained separated from the fluid within the chamber 34. The upper chamber fill tubing 42 provides an inlet for fluid into the upper chamber 32 whereas the lower chamber fill tubing 38 provides an inlet for fluid into the lower chamber 34. The lower chamber 34 additionally includes an injection inlet port 106 for injecting medication into the lower chamber 34 and an outlet IV port 108 for connection of an IV to a patient.

In order to fill the receiving bag 28 with fluid from any number of the source containers 20–25, the receiving bag 28 is suspended from the load cell hook 100. The load cell 48 provides weight information at various points in the filing process to the micro-processor in the controller 12. A technician operating the compounder system 10 enters via the key pad 44 the solutions from the source containers 20–25 that are to be transferred to the particular chambers 32 and 34 of the receiving bag 28 as well as the quantity of each such solution. The controller 12 then controls the activation sequentially of each of the pump stations 14–18 associated with the source containers 20–24. When a particular one of the pump stations 14–18, such as the pump station 14 is actuated, the peristaltic pump for that pump station 14 pumps the pump tubing 70 attached to that pump station 14 such that fluid flows from the source container 20 through the source tubing leg 58 of the flexible tubing 52, the pump tubing 70 and the output tubing 76 into one of the inlet ports 82 of the common manifold 36. The fluid flowing into the manifold 36 exits through the exit port 86 and through the lower chamber fill tubing 38 into the lower chamber 34 of the receiving bag 28. When the controller 12 determines that the desired amount of solution from the source container 20 has been supplied to the lower chamber 34, the controller 12 deactivates the pump station 14 and activates the next one of the pump stations 15–18 that needs to be activated to supply fluid from the particular source containers 21–24 to the lower chamber 34. The fluid from the source containers 21–24 flow through respectively the source tubing legs 59–62, the pump tubing 71–74 and the output tubing 77–80 into the inlet ports 82 of the common manifold 36. The fluid flowing into the common manifold 36 exits through the exit port 86 and flows through the lower chamber fill tubing 38 into the lower chamber 34 of the receiving bag 28.

After the solutions from the source containers 20–24 have been supplied to the lower chamber 34, fluid from the source container 25 can be supplied to the upper chamber 32. The controller 12 actuates the pump station 19 so that that peristaltic pump for that station 19 pumps the pump tubing 75. As a result, the solution from the source container 25 flows through the source tubing leg 63, the pump tubing 75 and the output tubing 81 into the inlet port 88 of the connector 40. The fluid then flows through the connector 40, out of the exit port 90 and through the upper chamber fill tubing 42 into the upper chamber 32. The filling of the upper chamber 32 is accomplished without the necessity of flushing solution from the manifold 36 because the solution from the source container 25 does not flow through the manifold 36 but instead through the separate connector 40 or without the necessity of inverting the receiving bag 28 because the connector 40 is positioned on the upstanding support 96 sufficiently close to the upper edge 102 of the receiving bag 28 that the upper chamber fill tubing 42 is long enough to be connected to the connector 40.

After the solutions from the selected ones of the source containers 20–24 have been supplied in the desired quantities to the lower chamber 34 and the solution from the source container 25 has been supplied to the upper chamber 32 in the desired quantity, the fill tubing 38 is sealed and disconnected from the exit port 86 of the manifold 36 and the fill tubing 42 is sealed and disconnected from the exit port 90 of the connector 40. The receiving bag 28 then can be removed from the load cell hook 100.

As long as the clamping mechanism 30 is clamped onto the receiving bag 28, the solutions in the chambers 32 and 34 are maintained separated. When the solutions within the receiving bag 28 is to be administered to a patient, the clamping mechanism is removed from the receiving bag 28 such that the chambers 32 and 34 are no longer separated. The solutions within those chambers 32 and 34 can be mixed so that the combined solutions may be administered to a patient through an IV tubing inserted into the outlet IV port 108.

Many modifications and variations of the present invention are possible in light of the above teachings. For example, different numbers of pump stations like the pump stations 14–19 or source containers like the source containers 20–25 may be included in the compounder system 10. Moreover, a plurality of different liquids can be transferred to the upper chamber 32 of the receiving bag 28 as well as the lower chamber 34 by providing an appropriate type of connector 40 for inter-connecting the fill tubing 42 to the plurality of source tubing. Thus, it is to be understood that, within the scope of the appended claims, the invention may be practiced other than as specifically described above.

What is claimed and desired to be secured by Letters Patent of the United States is:

1. A compounder system having a controller means for controlling transfer of at least a first fluid from a first source container means and at least a second fluid from a second source container means, said compounder system comprising:

a flexible bag having first and second chambers with said first and second chambers extending toward each other from opposed ends of said flexible bag and being defined by opposed sidewalls extending between said opposed ends;

a separating means extending across said flexible bag between said opposed sidewalls for temporarily separating said first chamber from said second chamber;

a first connector means;

a first fill means for interconnecting said first connector means to said first chamber at said opposed end from which said first chamber extends;

first source means for interconnecting said first source container means to said first connector means;

first pump means controlled by said controller and associated with said first source means for transferring a selected amount of said first fluid through said first source means, said first connector means and said first fill means to said first chamber;

a second connector means;

a second fill means for interconnecting said second connector means to said second chamber at said opposed end from which said second chamber extends;

second source means for interconnecting said second source container means to said second connector means; and second pump means controlled by said controller and associated with second source means for transferring a selected amount of said second fluid through said second source means, said second connector means and said second fill means to said second chamber.

2. A compounder system as set forth in claim 1 including support means from which said bag is suspended, for supporting said first connector means in close proximity to said first fill means and for supporting said second connector means in close proximity to said second fill means.

3. A compounder system as set forth in claim 1 wherein said first source container means includes a plurality of first source containers containing a plurality of different first fluids, wherein said first connector means is a first manifold having a plurality of first inlet ports and a first exit port, wherein said first fill means includes a first fill tubing for said first chamber coupled to said first exit port and wherein said first source means is a plurality of first source tubing, each of which first source tubing connects the first fluid from a particular one of said plurality of first source containers to one of said first inlet ports of said first manifold.

4. A compounder system as set forth in claim 3 wherein said second source container means includes at least one second source container containing a second fluid, wherein said second connector means is a second manifold having a second inlet port and a second exit port, wherein said second fill means includes a second fill tubing for interconnecting said second chamber to said second exit port and wherein said second source means is a second source tubing for connecting the second fluid from said second source container to said second inlet port of said second manifold.

5. A compounder system having a controller means for controlling transfer of a plurality of first fluids from a plurality of first source containers and at least a second fluid from a second source container, said compounder system comprising:

a receiving means having first and second chambers with said first and second chambers extending toward each other from opposed ends of said receiving means and being defined by opposed sidewalls extending between said opposed ends;

a separating means extending across said receiving means between said opposed sidewalls for temporarily separating said first chamber from said second chamber;

a first connector means;

a first fill tubing for interconnecting said first connector means to said first chamber at said opposed end from which said first chamber extends;

first source tubing means for interconnecting said first source containers to said first connector means;

first pump means controlled by said controller and associated with said first source tubing means for transferring a selected amount of each of said first fluids through said first source tubing means, said first connector means and said first fill tubing to said first chamber;

a second connector means;

a second fill tubing for interconnecting said second connector means to said second chamber at said opposed end from which said second chamber extends;

second source tubing means for interconnecting said second source container to said second connector means; and second pump means controlled by said controller and associated with second source tubing means for transferring a selected amount of said second fluid through said second source tubing means, said second connector means and said second fill tubing to said second chamber.

6. A compounder system as set forth in claim 5 wherein said receiving means is a flexible bag.

7. A compounder system as set forth in claim 5 wherein said first connector means is a first manifold having a plurality of first inlet ports and a first exit port, wherein said first fill tubing is coupled to said first exit port and wherein said first source tubing means is a plurality of first source tubing, each of which first source tubing connects the first fluid from a particular one of said plurality of first source containers to one of said first inlet ports of said first manifold.

8. A compounder system as set forth in claim 7 wherein said second connector means is a second manifold having a second inlet port and a second exit port, wherein said second fill tubing interconnects said second chamber to said second exit port and wherein said second source tubing means connects the second fluid from said second source container to said second inlet port of said second manifold.

9. A method of transferring a plurality of first fluids from a plurality of first source containers to a first chamber of a flexible bag and at least a second fluid from a second source container to a second chamber of said flexible bag separated from said first chamber by a clamp means secured across said flexible bag, said method comprising:

activating under the control of a controller means a plurality of first pump means resulting in the transfer of selected ones of said first fluids from said plurality of first source containers to said first chamber through first source tubing means interconnecting said first source containers to a first connector means and a first fill tubing interconnecting said first connector means to said first chamber; and activating thereafter under the control of said controller means at least a second pump means resulting in the transfer of said second fluid from said second source container to said second chamber through second source tubing means interconnecting said second source container to a second connector means and a second fill tubing interconnecting said second connector means to said second chamber; and removing said clamp means so that said first and second fluids from respectively said first and second chambers can be mixed together.

10. A compounder system having a controller means for controlling transfer of at least a first fluid from a first source container means and at least a second fluid from a second source container means, said compounder system comprising:

a flexible bag having first and second chambers with said first and second chambers extending toward each other from opposed ends of said flexible bag and being defined by opposed sidewalls extending between said opposed ends;

a separating means extending across said flexible bag between said opposed sidewalls for temporarily separating said first chamber from said second chamber;

connector means from which extends a first fill means for interconnecting said connector means to said first chamber at said opposed end from which said first chamber extends and from which extends a second fill means for interconnecting said connector means to said second chamber at said opposed end from which said second chamber extends;

first tube means coupled to said first source container means for interconnecting said first source container means to said connector means;

second tube means coupled to said second source container means for interconnecting said second source container means to said connector means; and pump means controlled by said controller for transferring a selected amount of said first fluid through said first tube means, said connector means and said first fill means to said first chamber and for transferring a selected amount of said second fluid through said second tube means, said connector means and said second fill means to said second chamber.

11. A compounder system as set forth in claim 10 wherein said first source container means includes a plurality of first source containers containing a plurality of different first fluids and said first tube means includes a plurality of tubes, each of which tubes is connected to one of said plurality of first source containers.

* * * * *